US012687004B2

(12) United States Patent
Shen

(10) Patent No.: US 12,687,004 B2
(45) Date of Patent: Jul. 21, 2026

(54) ANTI-ODOUR AND ANTI-CLOGGING VERTICAL FLOOR DRAIN CONVENIENT FOR CLEANING

(71) Applicant: Ningbo Jiaze Sanitary Ware Co., Ltd, Ningbo (CN)

(72) Inventor: Qifan Shen, Ningbo (CN)

(73) Assignee: Ningbo Jiaze Sanitary Ware Co., Ltd., Ningbo (CN)

( * ) Notice: Subject to any disclaimer, the term of this patent is extended or adjusted under 35 U.S.C. 154(b) by 0 days.

(21) Appl. No.: 18/635,076

(22) Filed: Apr. 15, 2024

(65) Prior Publication Data

US 2024/0417964 A1 Dec. 19, 2024

(30) Foreign Application Priority Data

Apr. 14, 2023 (CN) ..... 202320832643.7

(51) Int. Cl.
*E03F 5/04* (2006.01)

(52) U.S. Cl.
CPC .... *E03F 5/0407* (2013.01); *E03F 2005/0418* (2013.01)

(58) Field of Classification Search
CPC ..... E03F 5/0407; E03F 2005/0416; E03F 2005/0418
See application file for complete search history.

(56) References Cited

U.S. PATENT DOCUMENTS 3,042,210 A * 7/1962 Hattori ..... E03F 5/0407 210/163
4,463,461 A * 8/1984 van den Broeke ... E03F 5/0407 4/293
4,922,948 A * 5/1990 Van Dijk ..... E03C 1/282 137/550
5,028,320 A * 7/1991 Gaudin ..... E03F 5/0405 210/248
5,124,031 A * 6/1992 Dallmer ..... E03F 5/0407 210/232
8,720,477 B1 * 5/2014 Al-Hasan ..... E03F 5/0407 137/433
2022/0389702 A1 * 12/2022 Yang ..... C02F 1/50

FOREIGN PATENT DOCUMENTS

DE 9414560 U1 * 1/1995
KR 20070052721 A * 5/2007 ..... E03F 5/0407

OTHER PUBLICATIONS

Machine translation KR 20070052721.*
Machine translation DE 9414560.*

* cited by examiner

*Primary Examiner* — Kevin F Murphy
(74) *Attorney, Agent, or Firm* — Jose Cherson Weissbrot

(57) ABSTRACT

The present invention discloses an anti-odour and anti-clogging vertical floor drain convenient for cleaning, which comprises a base, a drainage cover and a cover plate, wherein a drainage pipe is arranged in the base, a drainage channel is formed between the drainage pipe and the base, and a drainage outlet is simultaneously arranged at the upper end of the base; the drainage cover is detachably connected above the drainage pipe and forms a drainage cavity and a water inlet communicated with the drainage pipe; the cover plate is placed at the drainage outlet of the base and forms a drainage gap with the base; and the drainage cover comprises a cover body and a sleeve.

9 Claims, 6 Drawing Sheets

ANTI-ODOUR AND ANTI-CLOGGING VERTICAL FLOOR DRAIN CONVENIENT FOR CLEANING

TECHNICAL FIELD

The present invention relates to the technical field of floor drains, in particular to an anti-odour and anti-clogging vertical floor drain convenient for cleaning.

BACKGROUND

Floor drain is a common facility in home life, usually installed in bathrooms, kitchens and other places. Its function is to drain water and prevent sewage from flowing backwards, and keep the room dry and clean. Floor drains are generally made of metal or plastic and have certain corrosion resistance. In daily use, it needs to clean the floor drain regularly to prevent blockage, and pay attention to avoid falling debris into it. In short, the floor drain, though seemingly insignificant, plays an important role. Proper use and maintenance of floor drain can ensure the health and comfort of family environment.

The blockage of floor drain is one of the common problems in family life. Floor drain is usually used for drainage, but it is easy to accumulate dirt and sundries if it is not cleaned for a long time, leading to blockage. Moreover, in daily use, the odor in the drainage pipeline is easy to flow backward into the room, which leads to the indoor odor. Therefore, the prior art discloses various floor drain drainage devices to solve the technical problems mentioned above.

For example, in the existing U.S. patents:

- the patent with a publication number of US20230040521A1 discloses a floor drain structure for preventing hair blockage, wherein a staggered cross bar structure can be used to wind hair conveniently and avoid blocking the drainage hole, but the patent does not have the function of preventing odor from flowing backwards;
- the patent with a publication number of U.S. Pat. No. 7,150,576B1 discloses a non-blocking drainage device for surface drainage device, which includes a basket with a side opening, allowing wastewater to flow through it and enter the drainage pipe with the basket; this patent can intercept the sewage in the water to avoid floor drain blockage, but it does not have the function of preventing odor from flowing backwards;
- the patent with a publication number of US20160060857A1 discloses an insect-proof and anti-odour drainage device, wherein water flows into the base, and then flows through the wall and rises along the wall in a roundabout way, so that part of the water flows into the drainage pipe from the through hole, and it is stored in the base to prevent insects and odor from entering from the drainage hole; however, this patent is inconvenient to disassemble the floor drain for cleaning and anti-clogging.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The present invention provides a vertical-drainage floor drain which is anti-odour, anti-clogging and easy to clean, so as to solve the problems of floor drain blockage and odor backflow in the above background technology.

In order to achieve the above purpose, the present invention adopts the following technical solutions:

- an anti-odour and anti-clogging vertical floor drain convenient for cleaning includes a base, a drainage cover and a cover plate, wherein a drainage pipe is arranged in the base, a drainage channel is formed between the drainage pipe and the base, and a drainage outlet is simultaneously arranged at an upper end of the base; the drainage cover is detachably connected above the drainage pipe and forms a drainage cavity and a water inlet communicated with the drainage pipe; and the cover plate is placed at the drainage outlet of the base and forms a drainage gap with the base;
- the drainage cover comprises a cover body and a sleeve, a plurality of brackets connecting the cover body and the sleeve are arranged between the cover body and the sleeve; and the sleeve is provided with an installation groove, and is detachably connected with the drainage pipe on the base through the installation groove.

An anti-odour and anti-clogging vertical floor drain convenient for cleaning, comprising a base and a cover plate, wherein the base comprises a seat body and a seat ring; the seat ring is fixedly connected to the seat body; at least two sides of an upper port of the seat body are provided with positioning support posts; the positioning support post comprises a positioning part and a rotating support part; a top surface of the rotating support part is provided with a support surface; the cover plate is located inside the seat ring; and two sides of a bottom of the cover plate are provided with positioning grooves corresponding to the rotating support part.

An anti-odour and anti-clogging method for a floor drain includes adopting an anti-odour and anti-clogging vertical floor drain convenient for cleaning comprising a base, a drainage cover and a cover plate, wherein a drainage pipe is arranged in the base, the base comprises a seat body and a seat ring, a drainage channel is formed between the drainage pipe and the seat body, and a drainage outlet is simultaneously arranged at an upper end of the base; the drainage cover is detachably connected above the drainage pipe to form a drainage cavity and a water inlet communicated with the drainage pipe; and the cover plate is placed at the drainage outlet of the base and forms a drainage gap with the base; the method includes the following steps:

- Step 1, embedding the base into the ground, and connecting the drainage pipe with a sewage pipe;
- Step 2, when sewage is discharged, long hair remaining above the gap between the cover plate and the seat ring, and then manually cleaning the residual hair to avoid blockage of the drain floor; and
- Step 3, when cleaning the interior of the floor drain, firstly, holding the cover plate and taking the cover plate out from the base, then holding the drainage cover and pulling the drainage cover out from the drainage pipe, and then cleaning the dirt accumulated in the drainage channel to avoid the blockage of the floor drain.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

Figure 1:
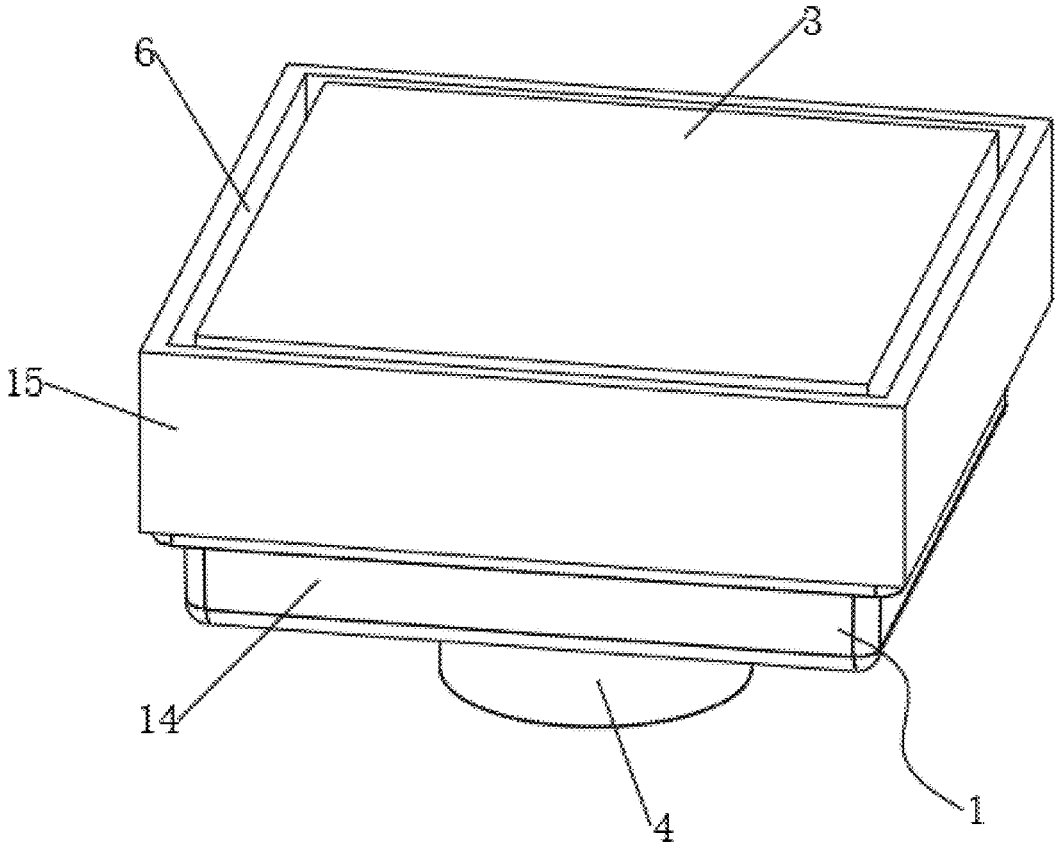
FIG. 1 is a schematic structural diagram of the whole invention.
Figure 2:
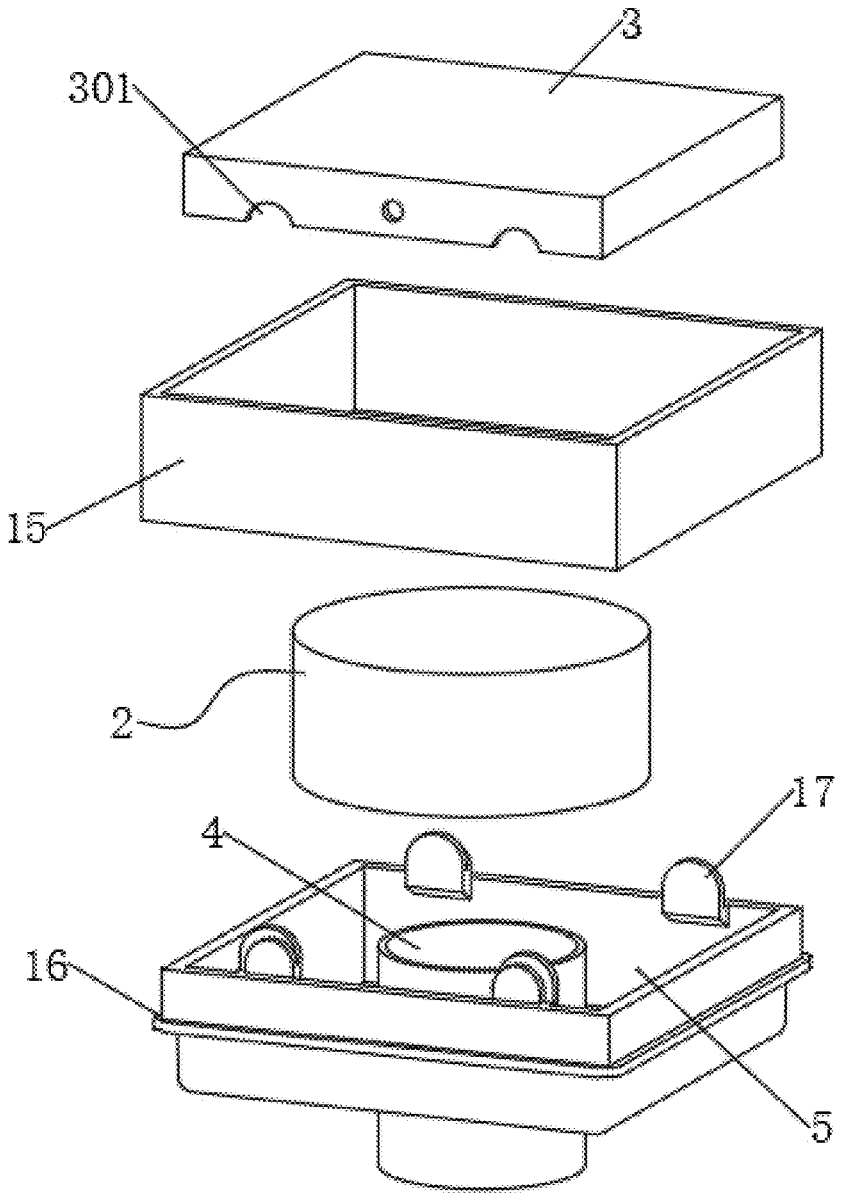
FIG. 2 is a schematic diagram of the explosion structure according to Embodiment 1 of the present invention.
Figure 3:
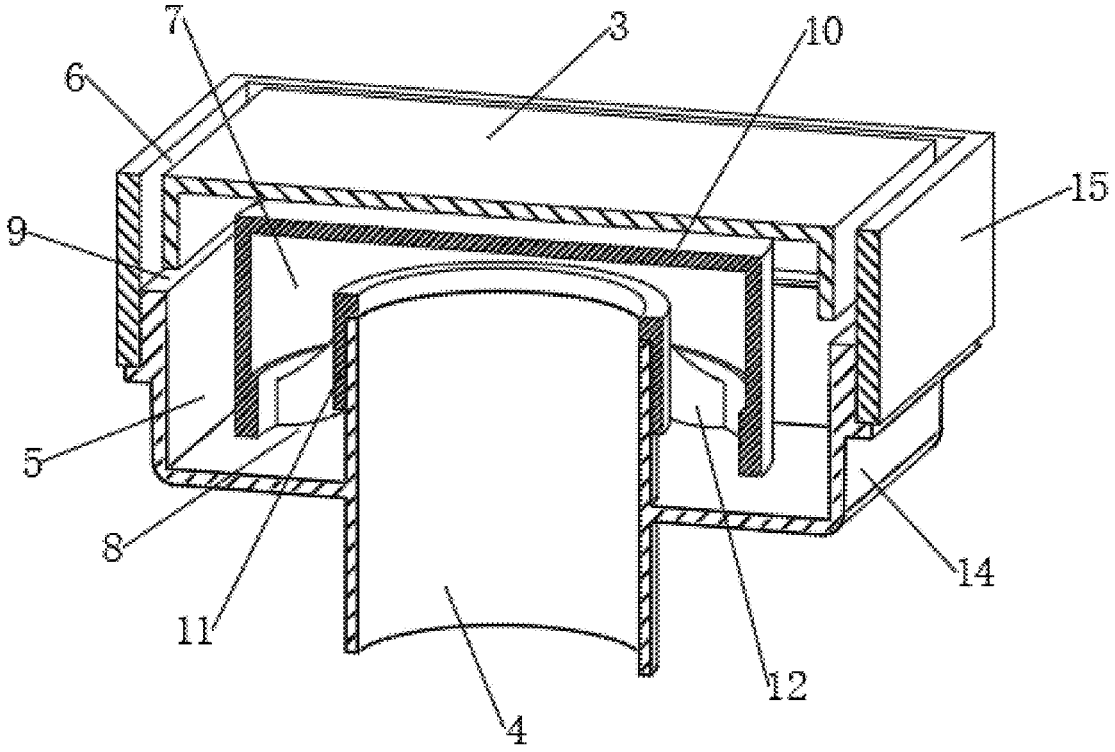
FIG. 3 is a sectional view of Embodiment 1 of the present invention.
Figure 4:
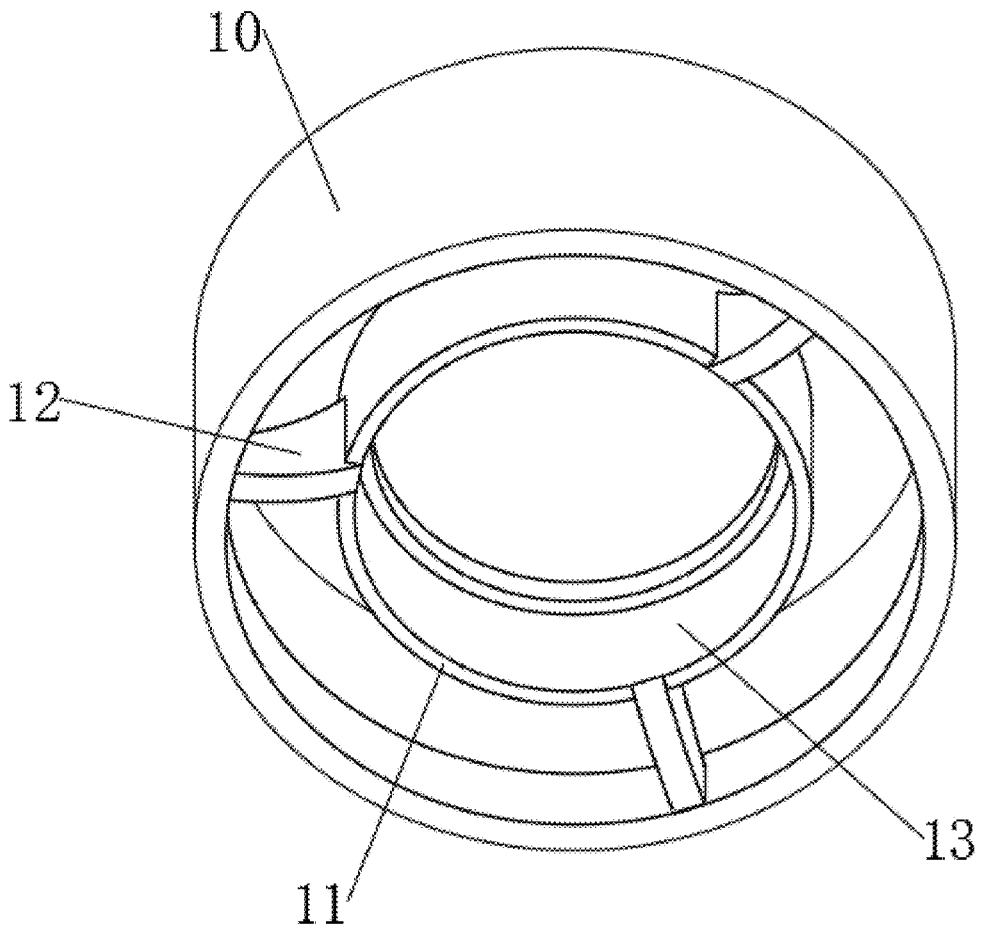
FIG. 4 is a schematic structural diagram of the drainage cover of the present invention.
Figure 5:
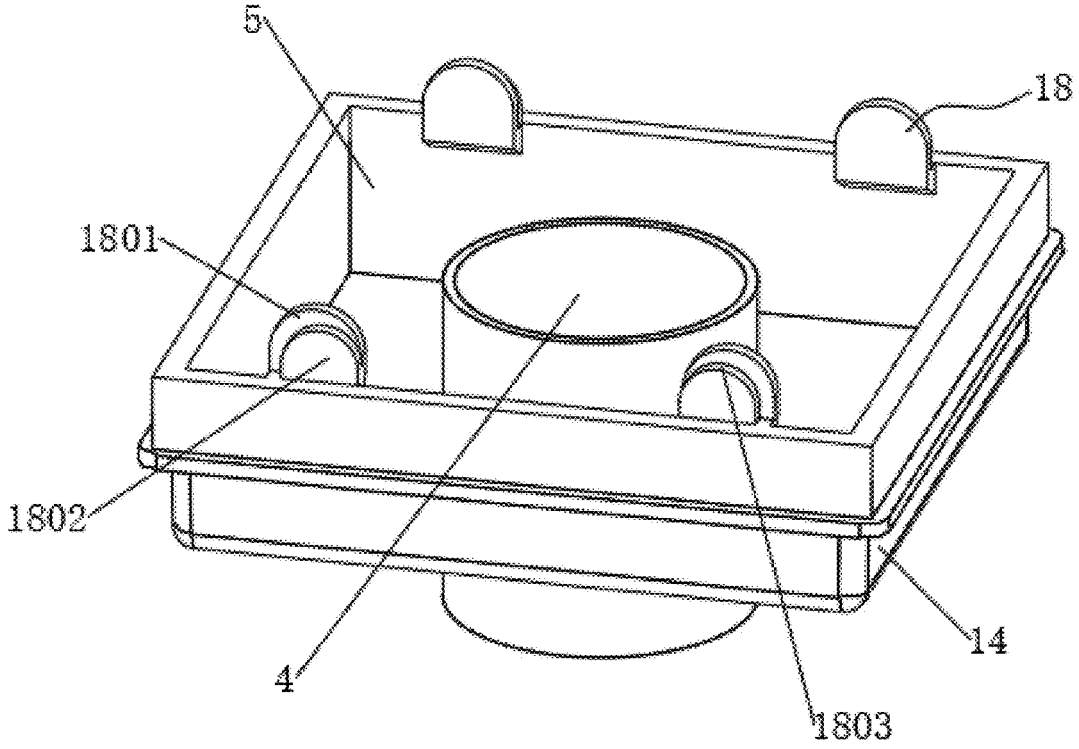
FIG. 5 is a schematic structural diagram of a seat body according to Embodiment 2 of the present invention.
Figure 6:
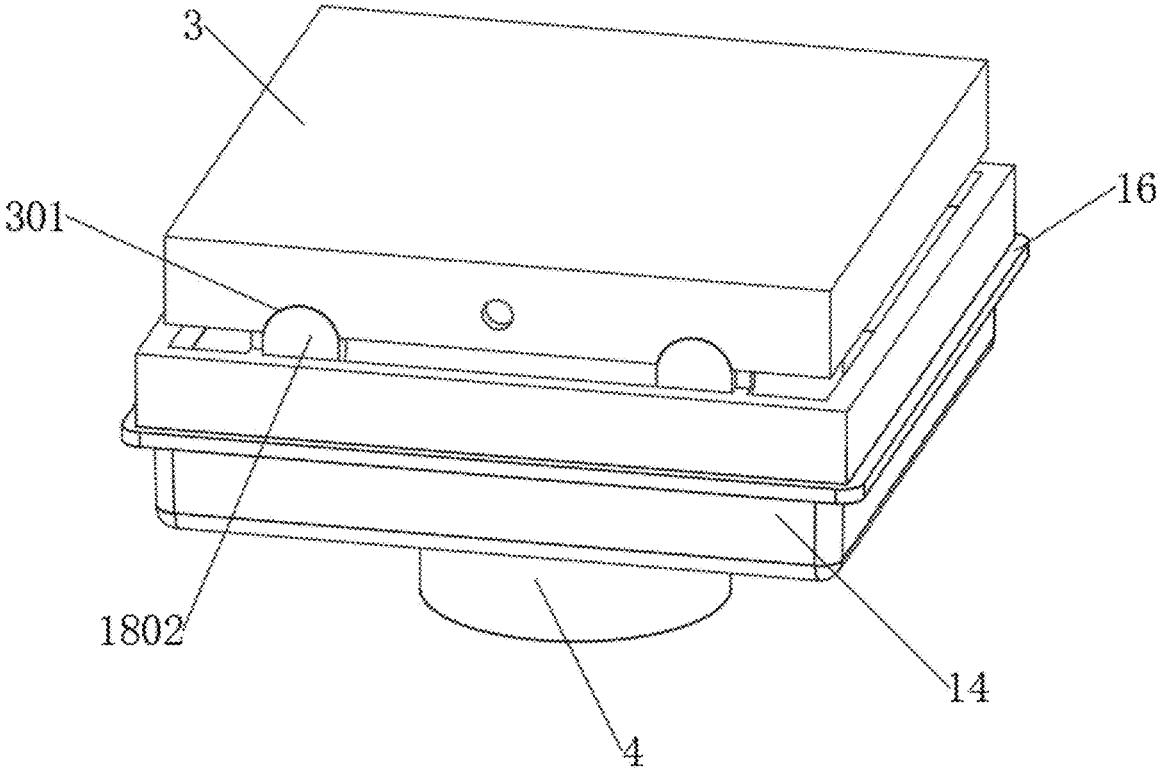
FIG. 6 is a state diagram of FIG. 5 when a cover plate is installed.

In the figures: Base (1), Drainage cover (2), Cover plate (3), Positioning groove (301), Drainage pipe (4), Drainage channel (5), Drainage outlet (6), Drainage cavity (7), Water inlet (8), Drainage gap (9), Cover body (10), Sleeve (11), Bracket (12), Installation groove (13), Seat body (14), Seat ring (15), Fixing groove (16), Positioning post (17), Positioning support post (18), Positioning part (1801), Rotating support part (1802), Support surface (1083).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

Embodiment 1

Please refer to FIG. 1 and FIGS. 2 to 4.

The present invention provides an anti-odour and anti-clogging vertical floor drain convenient for cleaning, which includes a base 1, a drainage cover 2 and a cover plate 3, wherein a drainage pipe 4 is arranged in the base 1, a drainage channel 5 is formed between the drainage pipe 4 and the base 1, and a drainage port 6 is simultaneously arranged at the upper end of the base 1; the drainage cover 2 is detachably connected above the drainage pipe 4 to form a drainage cavity 7 and a water inlet 8 communicated with the drainage pipe 4; the cover plate 3 is placed at the drainage port 6 of the base 1, and forms a drainage gap 9 with the base 1; the drainage cover 2 includes a cover body 10 and a sleeve 11, wherein a plurality of brackets 12 are arranged between the cover body 10 and the sleeve 11, the sleeve 11 is provided with an installation groove 13, and is detachably connected with the drainage pipe 4 on the base 1 through the installation groove 13;

specifically, the upper port of the drainage pipe 4 is located in the drainage channel 5, the water inlet 8 is located in the lower half of the drainage channel 5, with a height lower than that of the drainage port 6 and the upper port of the drainage pipe 4; and the drainage port 6, the drainage gap 9, the drainage channel 5, the water inlet 8, the drainage cavity 7 and the drainage pipe 4 are communicated;

when the floor drain is used, the base 1 is embedded in the ground, the top of the base 1 and the upper surface of the cover plate 3 are flush with the surface of the ground, and the bottom of the drainage pipe 4 is connected and communicated with a sewage pipe;

therefore, when the floor drain drains, the ground sewage enters the floor drain through the drainage port 6, then the sewage passes through the drainage gap 9, the drainage channel 5, the water inlet 8 and enters the drainage cavity 7 in turn, then the sewage in the drainage cavity 7 enters the drainage pipe 4, and the sewage in the drainage pipe 4 is discharged into the sewage pipe through the drainage pipe 4, thus realizing ground drainage.

In the process of sewage discharge, when the water level in the drainage cavity 7 is higher than the opening at the upper end of the drainage pipe 4, the liquid will flow downward from the drainage pipe 4 under the gravity of the liquid, and the water flow will continue and form a seal at the upper end of the opening of the drainage pipe 4. Once the water flows away, a local vacuum will appear at the upper part of the drainage cavity 7 of the drainage cover 2, and the sewage outside the drainage cover 2 will be continuously pressed into the drainage cover 2 under the action of atmospheric pressure, thus generating bell-type siphon phenomenon and realizing rapid drainage;

and in the process of drainage, long hair will stay above the gap of the cover plate 3, and solid dirt in sewage will be deposited at the bottom of the drainage channel 5;

when the ground sewage is exhausted, some sewage will remain in the drainage channel 5 and the drainage cavity 7 in the floor drain, and the residual sewage can water-seal between the room and the drainage pipe 4, so as to prevent the odor in the sewage pipe from flowing backwards indoors, which has a good deodorizing effect;

the inner surface of the drainage cover 2 is provided with spiral lines or spiral flow channels (not shown in the attached drawings), so that the flowing sewage can form a spiral water flow during drainage, thereby accelerating the water flow speed.

According to the above, the base 1 includes a seat body 14 and a seat ring 15, the seat ring 15 is fixedly connected to the seat body 14, the cover plate 3 is correspondingly located on the seat body 14 and in the seat ring 15; the upper port of the seat body 14 is provided with a fixing groove 16, the lower port of the seat ring 15 is sleeved in the fixing groove 16, and is fixedly connected with the seat ring 15 with sealant water; positioning posts 17 are installed on both sides of the upper port of the seat body 14, the two sides of the bottom of the cover plate 3 are provided with positioning grooves 301 corresponding to the positioning posts 17, and the positioning posts 17 are inserted into the positioning grooves 301; the seat body 14 and the drainage cover 2 are made of plastic materials, and the seat ring 15 and the cover plate 3 are made of metal materials;

through the matching between the installation groove 13 and the drainage pipe 4, the drainage cover 2 can be sleeved on the top of the drainage pipe 4, and at the same time, the drainage cover 2 can be pulled out from the top of the drainage pipe 4, while through the matching between the positioning groove 301 and the positioning post 17, the cover plate 3 can be covered on the top of the base 1, so that the cover plate 3 can be opened and the drainage cover 2 can be pulled out upward, so that the dirt accumulated in the base 1 can be cleaned very conveniently and the blockage can be effectively avoided.

Embodiment 2

Please refer to FIG. 1 and FIGS. 5 to 9.

The present invention provides an anti-odour and anti-clogging vertical floor drain convenient for cleaning, which includes a base 1 and a cover plate 3, wherein the base 1 includes a seat body 14 and a seat ring 15, the seat ring 15 is fixedly connected to the seat body 14, and at least two sides of the upper port of the seat body 14 are provided with positioning support posts 18.

Figure 7:
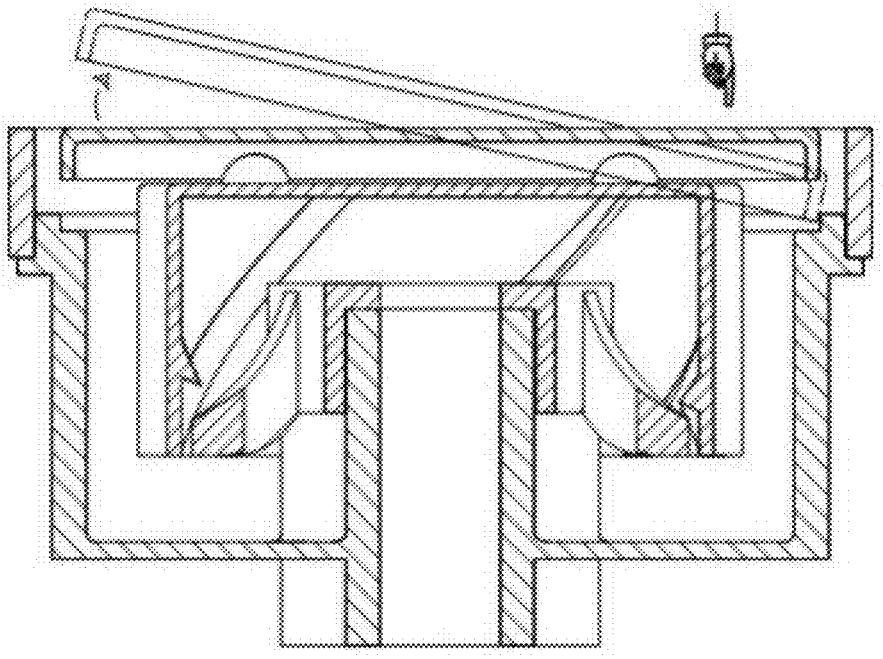
FIG. 7 is a state diagram when the cover plate of the present invention is tilted.

The difference between Embodiment 2 and Embodiment 1 is that:

the positioning support post 18 includes a positioning part 1801 and a rotating support part 1802, wherein the positioning part 1801 is located inside the rotating support part 1802, and the top surface of the rotating support part 1802 is provided with a support surface 1803; the cover plate 3 is located inside the seat ring 15, positioning grooves 301 corresponding to the rotating support part 1802 are formed on the two sides of the bottom of the cover plate 3, and the upper end of the rotating support part 1802 is inserted into the corresponding positioning grooves 301; the support surface 1803 and the inner surface of the positioning groove 301 are both arc surfaces and are connected in a sliding manner; the positioning part 1801 is located inside the cover plate 3 and is attached to the inner side of the cover plate 3;

by the positioning part 1801, when the cover plate 3 is covered on the base 1, since the positioning part 1801 is located inside the cover plate 3, the positioning part 1801 can limit the cover plate 3 in forward and backward directions to avoid the forward and backward displacement of the cover plate 3; and the support surface 1803 and the inner surface of the positioning groove 301 are set as arc surfaces, and after the positioning part 1801 is inserted into the positioning groove 301, the left and right direction of the cover plate 3 can be limited to avoid the left and right displacement of the cover plate 3;

moreover, by setting the support surface 1803 and the inner surface of the positioning groove 301 as arc surfaces, when the cover plate 3 needs to be removed from the base 1, only the left or right end of the cover plate 3 needs to be pressed downwards; when the left or right end of the cover plate 3 is pressed, a fulcrum will be formed at the contact point between the rotating support part 1802 and the positioning groove 301, and then the other end of the cover plate 3 will be tilted upwards by the lever principle, as shown in FIG. 7, so that in this way, when the cover plate 3 is disassembled, the cover plate 3 can protrude upward from the base 1, and then the cover plate 3 can be conveniently held and the convenience of disassembling the cover plate 3 can be improved.

Figure 8:
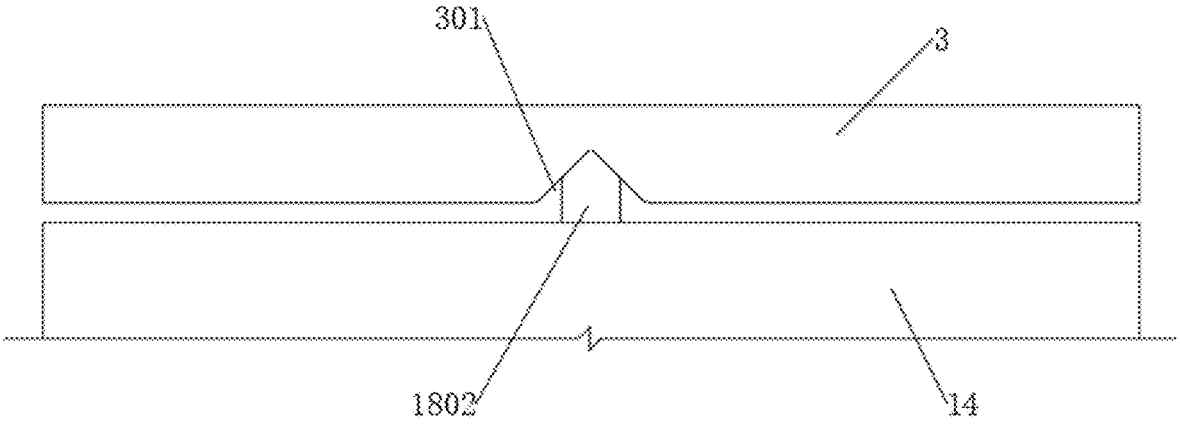
FIG. 8 is a schematic structural view of the second embodiment of the rotating support part of the present invention.

In Embodiment 2 of the rotating support part 1802, as shown in FIG. 8, the rotating support part 1802 is arranged in the middle of the upper port of the seat body 14, and the support surface 1803 and the positioning groove 301 are both triangular, and the two sides of the support surface 1803 are shorter than those of the positioning groove 301; with this structure, when one end of the cover plate 3 is pressed, the power arm formed between the pressing part and the rotating support part 1802 is longer, so that a smaller pressing force is needed when the cover plate 3 is tilted, which is more labor-saving.

Figure 9:
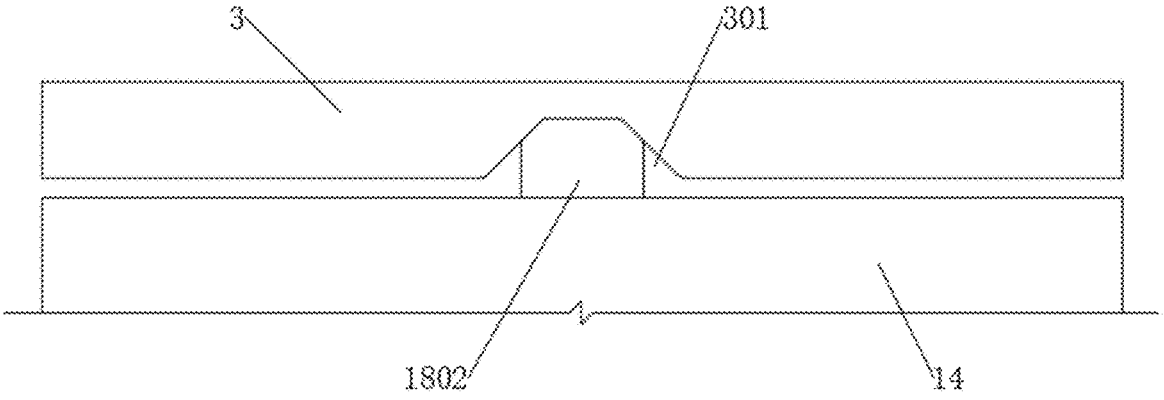
FIG. 9 is a schematic structural view of the third embodiment of the rotating support part of the present invention.

In Embodiment 3 of the rotating support part 1802, as shown in FIG. 9, different from the Embodiment 2, the support surface 1803 and the positioning groove 901 are trapezoidal, and the two sides of the support surface 1803 are shorter than the two sides of the positioning groove 301. Compared with the Embodiment 2, this structure can make the support of the cover plate 3 more stable.

In addition to the above three embodiments, the rotating support part 1802 and the support surface 1803 can also adopt any other geometric shape that can realize the tilting of the cover plate 3.

In other embodiments of the floor drain (not shown in the drawings):

The cross-sectional shapes of the base 1, the cover plate 3 and the drainage cover 2 are not limited to the rectangular or circular shapes shown in the attached drawings, but also can be other geometric shapes such as triangles and polygons, so that appropriate shapes can be selected according to actual needs to achieve the best drainage effect;

the seat body 14 and the seat ring 15 can also be fixedly connected in a clamping manner; by adopting the clamping connection mode, the seat body 14 and the seat ring 15 can be detached, thereby further facilitating the cleaning of the floor drain;

moreover, the seat body 14 and the seat ring 15 can be connected in an integrated way, which can save the processing and manufacturing cost of the floor drain;

the bracket 12 can also be connected between the cover body 10 and the sleeve 11 in a hollowed-out net structure, so that the bracket 12 can intercept and filter the sewage while playing the functions of connecting and supporting, and further improve the anti-clogging effect of the floor drain;

the sleeve 11 and the drainage pipe 4 can also be connected by threaded connection or clamping, which can improve the stability of the connection between the drainage cover 2 and the drainage pipe 4, so that the drainage cover 2 is not easily shaken due to the impact of water flow during drainage;

the connection mode of the drainage pipe 4 and the sewage pipe can also be connected by threads, so that the drainage pipe 4 and the sewage pipe can be detached, and the drainage pipe 4 can be connected with the seat body 14 by threads, so that the drainage pipe 4 and the seat body 14 can be detached, and thus when the drainage pipe 4 is damaged or blocked, the drainage pipe 4 can be detached from the seat body 14 for replacement or maintenance.

To sum up, compared with the prior art, the present invention has the following beneficial effects:

through the siphon phenomenon formed between the drainage cover 2 and the drainage pipe 4 in the base 1, rapid drainage can be realized; after the drainage is completed, water can be stored in the drainage channel 5 and part of the drainage cavity 7 to realize water sealing, thus achieving the deodorization effect; at the same time, in the process of drainage, short hair will be siphoned down, long hair will remain above the gap of the cover plate 3, and some impurities will be deposited at the bottom of the drainage channel 5; the cover plate 3 and the drainage cover 2 are detachably connected to facilitate the removal of the cover plate 3 and the drainage cover 2 to clean the sundries in the drain tank 5, thus effectively avoiding the occurrence of blockage.

Through the matching arrangement of the positioning support post 18 and the positioning groove 301, when the cover plate 3 is disassembled, the cover plate 3 can protrude upward from the base 1 by pressing the cover plate 3, so that it is convenient to hold the cover plate 3 and improve the convenience of disassembling the cover plate 3.

The present invention also provides an anti-odour and anti-clogging method for a floor drain, including adopting an anti-odour and anti-clogging vertical floor drain convenient for cleaning comprising a base 1, a drainage cover 2 and a cover plate 3, wherein a drainage pipe 4 is arranged in the base 1, the base 1 includes a seat body 14 and a seat ring 15, a drainage channel 5 is formed between the drainage pipe 4 and the seat body 14, and a drainage outlet 6 is simultaneously arranged at an upper end of the base 1; the drainage cover 2 is detachably connected above the drainage pipe 4 to form a drainage cavity 7 and a water inlet 8 communicated with the drainage pipe 4; and the cover plate 3 is placed at the drainage outlet 6 of the base 1 and forms a drainage gap 9 with the base 1; the method includes the following steps:

Step 1, embedding the base 1 into the ground, and connecting the drainage pipe 4 with a sewage pipe;

Step 2, during sewage discharge, long hair remaining above the gap between the cover plate 3 and the seat ring 15, and then manually cleaning the residual hair to avoid blockage of the floor drain; during sewage discharge, sewage sequentially passing through the drainage gap 9, the drainage channel 5, the water inlet 8 and enters the drainage cavity 7, then entering the drainage pipe 4, and the sewage in the drainage pipe 4 being discharged into the drainage pipeline; when the ground sewage is exhausted, part of the sewage remaining in the drainage channel 5 and the drainage cavity 7, and the remaining sewage water-sealing between the room and the drainage pipe 4 to prevent odor from flowing backwards;

Step 3, when cleaning the interior of the floor drain, firstly, holding the cover plate 3 and taking it out from the base 1, then holding the drainage cover 2 and pulling it out from the drainage pipe 4, and then cleaning the dirt accumulated in the drainage channel 5 to avoid the blockage of the floor drain; when the cover plate 3 is taken, one end of the cover plate 3 being pressed down by a hand, and then the other end of the cover plate 3 being tilted upward, and then grasping the tilted end to take the cover plate 3 off the base 1.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

What is claimed is:

1. An anti-odour and anti-clogging vertical floor drain convenient for cleaning, comprising a base, a drainage cover and a cover plate, wherein a drainage pipe is arranged in the base, a drainage channel is formed between the drainage pipe and the base, and a drainage outlet is simultaneously arranged at an upper end of the base; the drainage cover is detachably connected above the drainage pipe and forms a drainage cavity and a water inlet communicated with the drainage pipe; and the cover plate is placed at the drainage outlet of the base and forms a drainage gap with the base;

the drainage cover comprises a cover body and a sleeve, a plurality of brackets connecting the cover body and the sleeve are arranged between the cover body and the sleeve; and the sleeve is provided with an installation groove, and is detachably connected with the drainage pipe on the base through the installation groove.

2. The anti-odour and anti-clogging vertical floor drain convenient for cleaning according to claim 1, wherein an upper port of the drainage pipe is located in the drainage channel, and the water inlet is located in a lower half of the drainage channel, with a height lower than that of the drainage outlet and the upper port of the drainage pipe.

3. The anti-odour and anti-clogging vertical floor drain convenient for cleaning according to claim 1, wherein the drainage outlet, the drainage gap, the drainage channel, the water inlet, the drainage cavity and the drainage pipe are communicated.

4. The anti-odour and anti-clogging vertical floor drain convenient for cleaning according claim 1, wherein the base comprises a seat body and a seat ring, the seat ring is fixedly connected to the seat body, and the cover plate is correspondingly located on the seat body and the seat ring.

5. The anti-odour and anti-clogging vertical floor drain convenient for cleaning according claim 4, wherein an upper port of the seat body is provided with a fixing groove, and a lower port of the seat ring is sleeved at the fixing groove and fixedly connected with the seat ring with sealant water.

6. The anti-odour and anti-clogging vertical floor drain convenient for cleaning according claim 4, wherein positioning posts are installed on both sides of the upper port of the seat body.

7. The anti-odour and anti-clogging vertical floor drain convenient for cleaning according to claim 6, wherein two sides of a bottom of the cover plate are provided with positioning grooves corresponding to positioning posts, and the positioning posts are inserted into the positioning grooves.

8. The anti-odour and anti-clogging vertical floor drain convenient for cleaning according to claim 4, wherein the seat body and the drainage cover are made of plastic materials, and the seat ring and the cover plate are made of metal materials.

9. The anti-odour and anti-clogging vertical floor drain convenient for cleaning according to claim 1, wherein an inner surface of the drainage cover is provided with spiral lines or spiral flow channels.

* * * * *